US008544541B2

(12) United States Patent
Bishop

(10) Patent No.: US 8,544,541 B2
(45) Date of Patent: Oct. 1, 2013

(54) PACKER SUPPORTED ON BONDED CONNECTION TO A SURROUNDING TUBULAR

(75) Inventor: David S. Bishop, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 237 days.

(21) Appl. No.: 13/110,722

(22) Filed: May 18, 2011

(65) Prior Publication Data

US 2012/0292014 A1 Nov. 22, 2012

(51) Int. Cl.
*E21B 33/13* (2006.01)

(52) U.S. Cl.
USPC ..... 166/120; 166/134

(58) Field of Classification Search
USPC ..... 166/118, 120, 134
See application file for complete search history.

(56) References Cited

U.S. PATENT DOCUMENTS

| | | | | |
|---|---|---|---|---|
| 2,173,903 | A * | 9/1939 | Halliburton | 277/340 |
| 8,047,279 | B2 * | 11/2011 | Barlow et al. | 166/134 |
| 2002/0121160 | A1 * | 9/2002 | Bangert | 81/57.5 |
| 2010/0276159 | A1 * | 11/2010 | Mailand et al. | 166/382 |
| 2011/0088891 | A1 * | 4/2011 | Stout | 166/120 |

* cited by examiner

*Primary Examiner* — William P Neuder
(74) *Attorney, Agent, or Firm* — Steve Rosenblatt

(57) ABSTRACT

A packer or bridge plug has slips that bind to the surrounding tubular with an adhesive bond. The tubular wall is not penetrated but a roughening of the target location in the tubular can help the bond material to adhere to support the packer or bridge plug. A removable cover can overlay the surface to be bonded to the tubular and the cover can come off in a variety of techniques before the members to be bonded are radially extended. An acrylic adhesive can be the bonding agent. The packer or bridge plug can be made of mostly or entirely non-metallic materials to facilitate mill out.

9 Claims, 1 Drawing Sheet

PACKER SUPPORTED ON BONDED CONNECTION TO A SURROUNDING TUBULAR

FIELD OF THE INVENTION

The field of the invention is packers or bridge plugs used in subterranean locations and more particularly where the set support to the surrounding tubular is made with an extending anchoring member that bonds to the surrounding tubular.

BACKGROUND OF THE INVENTION

Packers and bridge plugs typically have one or more seal rings that are flanked by slips. Slips are tapered elements that ride up cones that are brought closer together in opposite directions toward the sealing element. As a result the sealing element is compressed and the slips are forced out radially as well to get a penetrating bite into the surrounding tubular. This penetration is accomplished with serrations or wickers on the face of the slips that contacts the tubular. In some applications hardened carbide inserts are teamed up with wickers to enhance the grip of the packer or the bridge plug.

While the wickers and inserts increase the support for the packer or the bridge plug against differential pressures, they also can cause localized stresses in the surrounding tubular that over time can cause cracks and even leakage. Any such occurrence would then require a production outage and a very expensive workover to patch the casing, for example. If for any reason the packer or bridge plug has to be drilled out, the penetrating wickers make the milling more difficult not only from the perspective that they are penetrating the casing wall but also from the perspective that they made be fabricated or cast from materials that increase the milling time to get the packer or the bridge plug to release.

The trend has been to make slips bite the casing and in some instances to produce the slip from a cast material that is fairly brittle as an aid in breaking up the slips to get the packer or bridge plug to release when milling. The present invention seeks to go in a new direction by using a bonded connection of the slip to the surrounding tubular. In the preferred embodiment the slip preferably has an acrylic adhesive applied to the contact face with the tubular. A removable cover that comes off at the desired depth in a variety of ways can be incorporated to protect the bonded face before application against the surrounding tubular. Surface roughening of the bonded slip face and of the surrounding tubular can also increase the strength of the bonded grip. The slip materials and for that matter the components of the packer or bridge plug can be non-metallic or composite materials, for example that will also shorten the milling out time. Conventional setting mechanisms can be deployed to extend the slips and trigger the bond that are for example accomplished with string manipulation, wellbore hydrostatic or with pressure in the tubing applied from the surface. Those skilled in the art will more readily appreciate various aspects of the invention from a review of the description of the preferred embodiment and the associated drawings while keeping in mind that the full scope of the invention is to be determined by the appended claims.

SUMMARY OF THE INVENTION

A packer or bridge plug has slips that bind to the surrounding tubular with an adhesive bond. The tubular wall is not penetrated but a roughening of the target location in the tubular can help the bond material to adhere to support the packer or bridge plug. A removable cover can overlay the surface to be bonded to the tubular and the cover can come off in a variety of techniques before the members to be bonded are radially extended. An acrylic adhesive can be the bonding agent. The packer or bridge plug can be made of mostly or entirely non-metallic materials to facilitate mill out.

DETAILED DESCRIPTION OF THE PREFERRED EMBODIMENT

Figure 1:
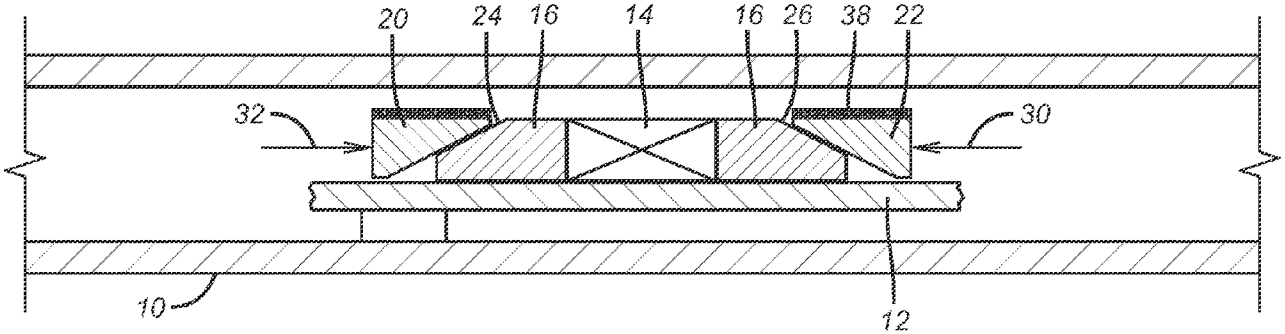
FIG. 1 shows the run in position of the packer or bridge plug.
Figure 2:
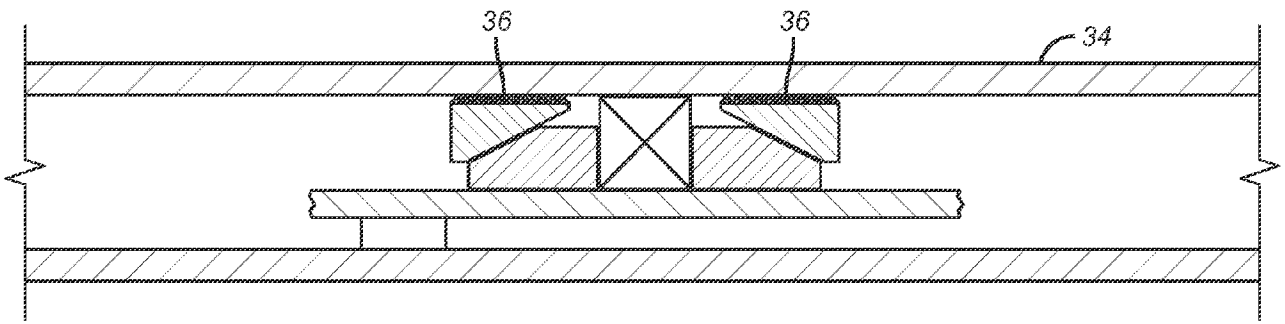
FIG. 2 is the view of FIG. 1 in the set position against a surrounding tubular.

FIG. 1 illustrates a tubular string 10 that supports a packer mandrel 12. On the mandrel 12 are a sealing element 14 with cones 16 and 18 on opposed sides of the element 14. Slips 20 and 22 are located to the outside of the cones 16 and 18. Slips 20 and 22 respectively ride up ramps 24 and 26. The mechanism to move the assembly from the FIG. 1 run in position to the FIG. 2 set position is illustrated schematically with arrows 30 and 32 showing opposed forces that compress the seal 14 and cause the slips 20 and 22 to ride up ramps 24 and 26 for radial extension to the surrounding tubular 34. The slips 20 and 22 feature preferably an acrylic adhesive 36 on the outermost surface that is designed to contact the surrounding tubular 34 on radial extension in the FIG. 2 position. Also schematically illustrated in FIG. 1 is a temporary cover 38. This cover can keep well fluids off the adhesive until the desired set location is reached. Removal of the cover can occur with the addition of a fluid to the wellbore or reactive or thermal effects from expected well fluids that will weaken and rapidly disintegrate the cover 38 before the slips 20 and 22 are radially extended. For example the presence of water or hydrocarbons in the wellbore can be the removal agent for the cover 38.

Several design options are contemplated. The adhesive 36 can be applied to a roughened surface on the outer face of the slips 20 or 22. Instead of slips that straddle the seal 14 the slip pair can be a single bidirectional slip that appears above or below the seal 14. If it is known ahead of time when the tubular 34 is run into a wellbore where the packer or bridge plug is to be set, then the interior surface of the tubular 34 can be roughened to enhance the grip area and improve resistance to applied differential pressures. The material for the slips 20 or 22 can be of a non-metallic or composite material to facilitate milling out.

The use of a bonded relationship between the slips and the surrounding tubular avoids penetration into the wall of the surrounding tubular 34 that occurs with slips that have external wickers and hardened inserts that are expressly designed to penetrate the wall of the surrounding tubular. The objective with slips 20 and 22 is to firmly grab by radial extension and adhere with the adhesive to retain the packer or bridge plug in position against differentials in either direction.

The setting mechanism can be mechanical through string manipulation with drag blocks or tubing pressure or annulus hydrostatic pressure or other known setting devices for packers and bridge plugs. In the run in position, the slips are retracted radially further in toward the mandrel 12 than the sealing element 14 or associated backup rings that are not shown but well known in the art. The use of the bonding relationship will facilitate milling out especially if the components are non-metallic. The bond relationship will offer less resistance to milling making the removal process faster. The avoidance of wall penetration will create less wall stress in the casing or tubing to which the slips are adhered so as to avoid risk of cracks that would bring on the need for a costly workover.

The above description is illustrative of the preferred embodiment and many modifications may be made by those skilled in the art without departing from the invention whose scope is to be determined from the literal and equivalent scope of the claims below:

I claim:

1. A packer or bridge plug assembly for subterranean use, comprising:

a mandrel supporting a sealing element, at least one slip and a setting assembly to selectively extend said at least one slip and sealing element to a surrounding tubular;

said at least one slip supporting said mandrel by a bonded contact to the surrounding tubular;

said at least one slip further comprises an adhesive forming an outwardly facing contact surface for adhering to the surrounding tubular.

2. The assembly of claim 1, wherein:

said outwardly facing contact surface of said slip does not penetrate into the surrounding tubular.

3. The assembly of claim 1, wherein:

said outwardly facing contact surface to which said adhesive is applied is roughened.

4. The assembly of claim 1, wherein:

said slip is made of a non-metallic material.

5. The assembly of claim 1, wherein:

said at least one slip comprises spaced slips that straddle said sealing element.

6. The assembly of claim 5, wherein:

said mandrel comprises opposed cones that guide the movement of said slips into a bonded relation with the surrounding tubular.

7. A packer or bridge plug assembly for subterranean use, comprising:

a mandrel supporting a sealing element, at least one slip and a setting assembly to selectively extend said slips and sealing element to a surrounding tubular;

said at least one slip supporting said mandrel by a bonded contact to the surrounding tubular;

said at least one slip further comprise an adhesive on an outwardly facing contact surface for the surrounding tubular;

said adhesive comprises an acrylic adhesive.

8. A packer or bridge plug assembly for subterranean use, comprising:

a mandrel supporting a sealing element, at least one slip and a setting assembly to selectively extend said slips and sealing element to a surrounding tubular;

said at least one slip supporting said mandrel by a bonded contact to the surrounding tubular;

said at least one slip further comprise an adhesive on an outwardly facing contact surface for the surrounding tubular;

said adhesive is initially covered for run in with a removable cover on said slip.

9. The assembly of claim 8, wherein:

said cover is removed reactively, thermally or by dissolving.

* * * * *